United States Patent [19]

Bingham et al.

[11] Patent Number: 5,054,140

[45] Date of Patent: Oct. 8, 1991

[54] HOSPITAL BED DEVICE

[76] Inventors: Grady A. Bingham, Buck Rd., Rte. 2, Box 741-A, Eden, N.C. 27288; Henry P. Brown, II, Rte. 8, Box 18, Reidsville, N.C. 27320

[21] Appl. No.: 569,592

[22] Filed: Aug. 20, 1990

Related U.S. Application Data

[63] Continuation of Ser. No. 320,539, Mar. 8, 1989, abandoned.

[51] Int. Cl.[5] ..... A61G 7/10

[52] U.S. Cl. ..... 5/61; 5/81 B; 5/88

[58] Field of Search ..... 5/61, 81 R, 453, 63, 5/88, 81 B; 414/921

[56] References Cited

U.S. PATENT DOCUMENTS

| | | | |
|---|---|---|---|
| 2,655,667 | 10/1953 | Burkert | 5/61 |
| 2,812,524 | 11/1957 | Pruitt | 5/61 |
| 2,869,623 | 1/1959 | Poulin | 5/81 R |
| 3,302,219 | 2/1967 | Harris | 5/61 X |
| 3,820,176 | 6/1974 | Feiertag | 5/81 R X |
| 4,155,587 | 5/1979 | Mitchell | 5/81 B X |
| 4,327,453 | 5/1982 | Sefton | 5/81 R |
| 4,502,169 | 3/1985 | Persson | 5/61 X |
| 4,729,598 | 3/1988 | Hess | 5/453 X |
| 4,747,170 | 5/1988 | Knouse | 5/81 R X |
| 4,776,047 | 10/1988 | DiMatteo | 5/81 R |
| 4,797,962 | 1/1989 | Goode | 5/453 |
| 4,809,804 | 3/1989 | Houston et al. | 5/81 R |
| 4,843,665 | 7/1989 | Cockel et al. | 5/65 |
| 4,912,787 | 4/1990 | Bradcovich | 5/63 X |

*Primary Examiner*—Gary L. Smith
*Assistant Examiner*—Michael Milano

[57] ABSTRACT

A hospital bed device is presented which includes hydraulic cylinders for lifting rollers positioned along each side of the bed. The rollers are driven by fractional horsepower electric motors and an endless belt is connected to the rollers whereby a patient lying thereon can be lifted and moved as the belt turns. The device provides a safe and convenient method to turn bedridden patients that otherwise may develop bed sores, pneumonia, or other consequential ailments.

3 Claims, 5 Drawing Sheets

HOSPITAL BED DEVICE

This is a continuation of application Ser. No. 07/320,539 filed 08 March 1989, now abandoned.

BACKGROUND OF THE INVENTION

1. Field Of The Invention

The invention herein pertains to an attachment for a hospital bed to assist patient care personnel with the lifting and turning of bedridden patients to prevent bedsores and other ailments from occuring which arise from prolonged inactivity while in contact with bed surfaces.

2. Description Of The Prior Art And Objectives Of The Invention

By utilizing improved health care procedures in recent years, hospital and nursing homes have increased the life span of patients and consequently the number of patients that are bedridden and which remain inactive for extended periods of time. Some of these patients have lung and chest infections and accordingly must be turned in their beds periodically to help prevent the possibility of developing pneumonia and other serious lung related diseases. Additionally, some bedridden patients are prone to develop bed sores and other painful skin conditions if they are not "turned" periodically. Nurses and other medical personnel are generally used to lift and turn such patients but with the rising cost of labor, hospitals have become increasingly sensitive to such expenses and other means are being sought to reduce operating and personnel costs. Also, with large adult patients, hospitals risk muscle, back and other injuries to their employees when attempts are made to lift and turn heavy bedridden patients and accordingly the present invention was conceived with one of its objectives being to provide a bed to eliminate medical personnel from having to manually lift and turn bedridden patients.

It is still another objective of the present invention to provide a device which will attach to conventional hospital beds for automatically turning patients as required.

It is yet another objective of the present invention to provide a device which can move the patient from one side of the bed to the other as needed for feeding, treatment administration or otherwise.

It is also another objective of the present invention to provide a device which is relatively simple to install and which can be used for automatically lifting and turning a patient by a single hospital employee.

It is still another objective of the present invention to provide a device which includes hand and foot controls for simplicity in operation.

Various other objectives and advantages of the present invention will become apparent to those skilled in the art as a more detailed explanation of the invention is presented below.

SUMMARY OF THE INVENTION

The present device consists of an attachment to a conventional hospital bed for assisting the movement of bedridden patients. The device is attached to the bed frame underneath the mattress and a pair of rollers are mounted on each side of the bed with a pair of fractional horsepower electric motors to turn the rollers. A belt formed from a bed sheet is joined to the rollers, which in a most downward position, the rollers are substantially the same height as the upper surface of the mattress. A hand actuator is electrically joined to motors for controlling the rotation of the rollers and a pair of foot pedals control the hydraulic cylinder pump. Upon selected activation, the rollers turn either in a clockwise or counterclockwise direction and act as a means to move the patient that has been placed on top of the belt, from one side of the bed to the other. Hydraulic cylinders which are affixed to the rollers will lift the rollers whereby the patient can be raised on one side of the bed or the other thereby allowing the patient to be turned as one of the rollers raises and the belt revolves. The rollers "lock" after full extension for safety purposes.

DESCRIPTION OF THE PREFERRED EMBODIMENT

Figure 1:
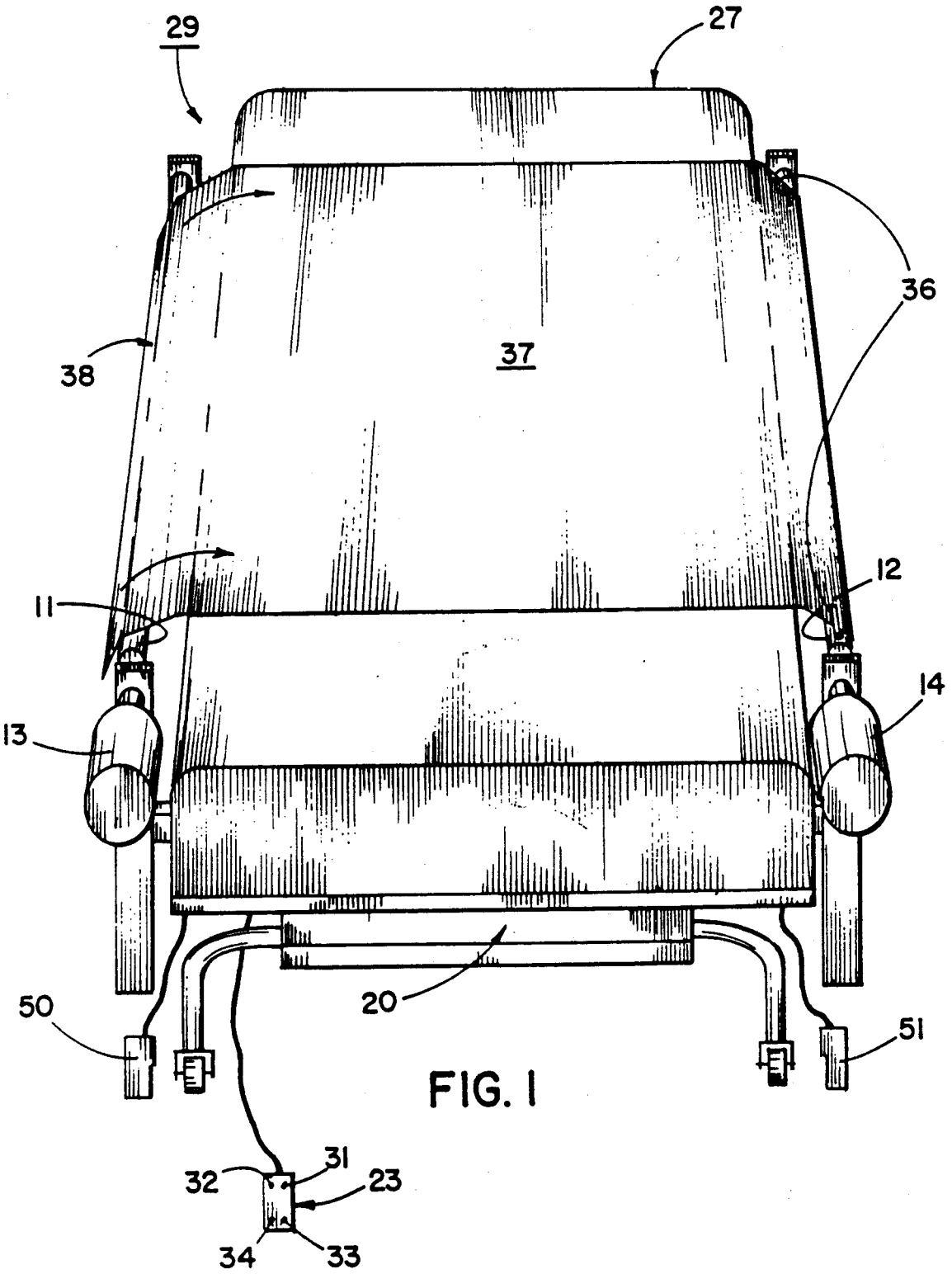
FIG. 1 illustrates a perspective view of a hospital bed with the invention affixed as shown from the foot of the bed.
Figure 2:
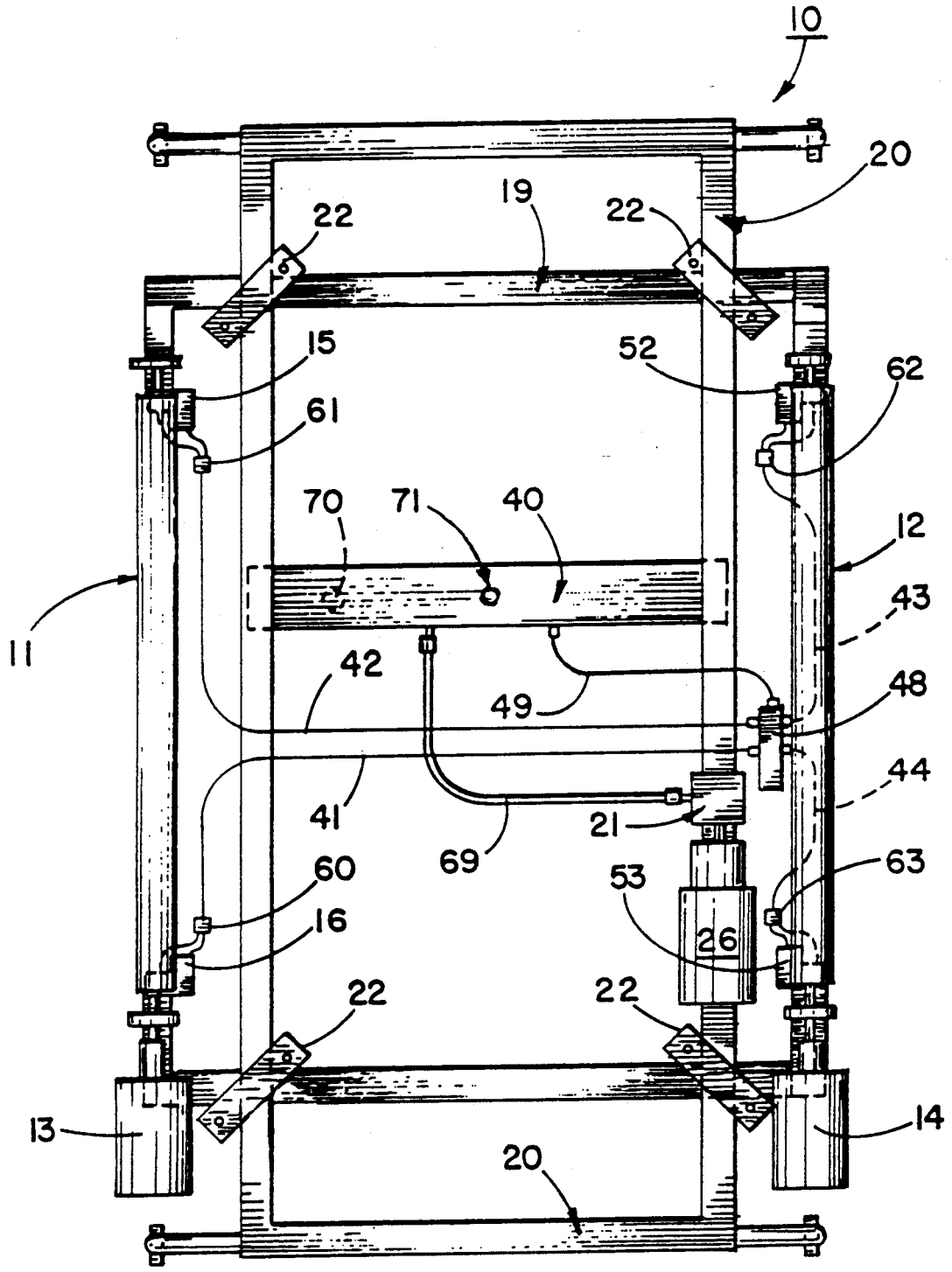
FIG. 2 shows a top view of the hydraulic assembly of the invention with the mattress and springs removed from the bed frame.

The preferred form of the invention is shown in FIGS. 1 through 5 which illustrates a hospital bed device which is joined by brackets underneath a conventional bed frame, x-ray cot or the like. As seen in FIG. 2 a pair of fractional horsepower electric motors drive rollers which are positioned in longitudinal alignment with the bed and are raised and lowered by attached hydraulic cylinders. A hydraulic fluid reservoir is positioned underneath the bed and is connected to the bed frame to enable a pump to force hydraulic fluid through the hydraulic lines to raise the rollers via the hydraulic pistons within the cylinders positioned on each side of the bed. A hand held actuator controls the electric motors while foot controls activate the pump for the hydraulic cylinders. The right roller rotates in a clockwise direction and the left roller rotates in a counterclockwise direction (as viewed from the foot of the bed) to move the patient thereon.

By utilizing the hand held actuator either the left or right roller can be lifted independently or the rollers can remain in a downward posture and the belt which is formed from a folded bed sheet can be turned in a clockwise or counterclockwise direction to move and turn the patient as needed respectively, to the right or left side of the bed.

DETAILED DESCRIPTION OF THE DRAWINGS AND OPERATION OF THE INVENTION

Turning now to the drawings, hospital bed device 10 as shown in FIG. 2 includes left roller 11 and right roller 12 which are formed from neoprene or other suitable materials. Rollers 11 and 12 are bearingly supported and are driven respectively by 110 volt ¼ horsepower motors 13 and 14. As further seen in FIG. 3, roller 11 is affixed to front hydraulic cylinder 15 and to rear hydraulic cylinder 16. Hydraulic cylinder 15 includes piston rod 17 and rear hydraulic cylinder 16 includes piston rod 18 shown extended in dotted line fashion where it is "locked" in place. Device frame 19 is attached to bed frame 20 which consists of a conventional hospital bed frame by steel clamp brackets 22 (FIG. 2). Control actuator 23 is of the hand held type whereas foot actuators 50 and 51 are located on the floor to activate hydraulic pump 21 attached to frame 19 prior to depressing right roller lift button 31 or left roller lift button 32 on control actuator 23. In the event it is not desirable to lift either roller 11 or 12, the patient can be moved from one side to the other side of bed 29 by depressing either control buttons 33 or 34 of actuator 23 which allows rollers 11 and 12 to rotate respectively in a counterclockwise or clockwise direction as viewed from the foot of bed whereby bed device 10 acts as a means to move patient 80 from side to side.

Figure 3:
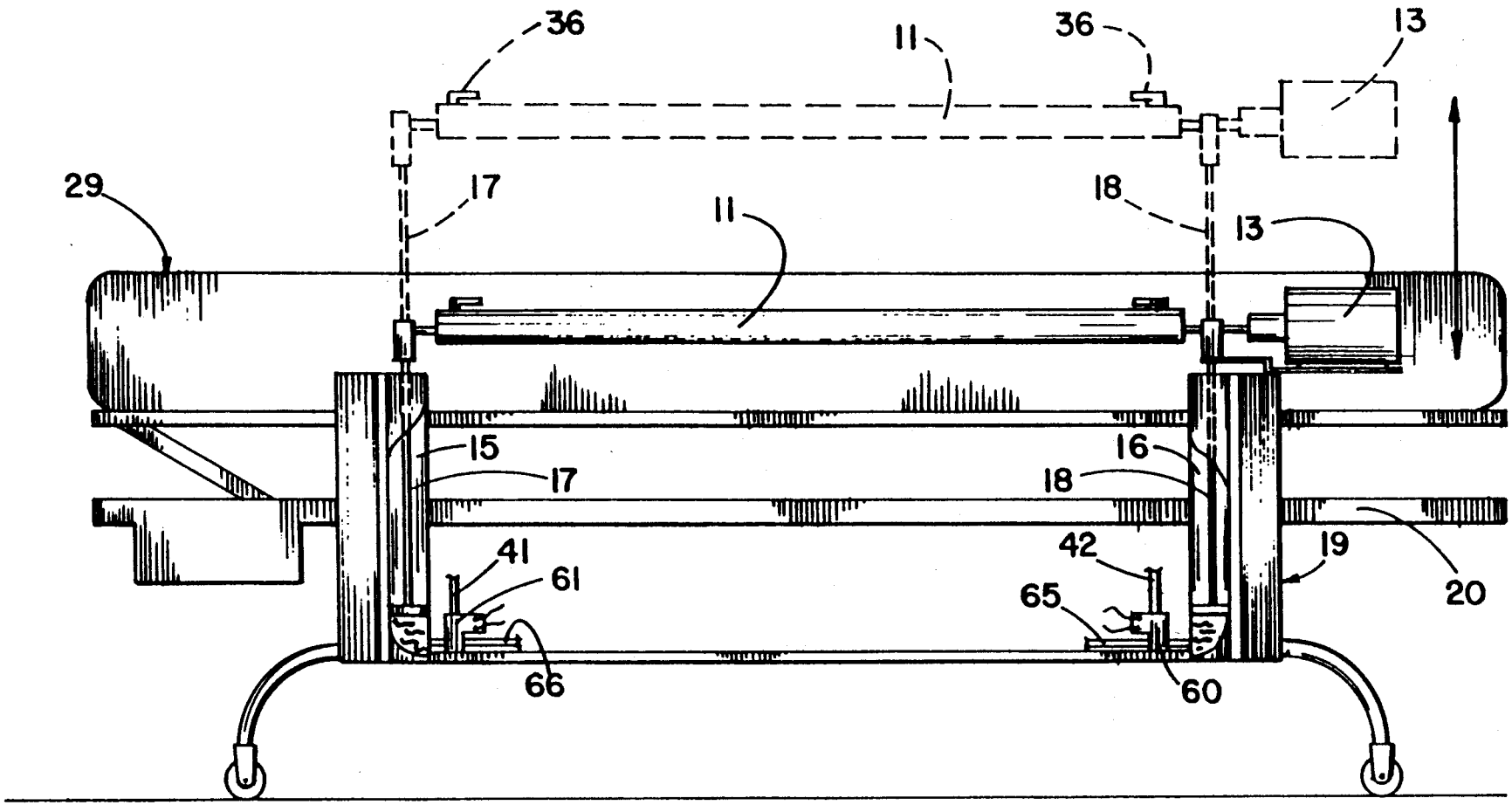
FIG. 3 demonstrates a left side elevation view of the device as shown in FIG. 1 with the left roller lifted as seen by dotted lines with the belt removed from the rollers.

Upon depression of either foot actuator 50 or 51 electric motor 26 is activated which consists of a one-third horsepower 110 volt AC electric motor, which drives pump 21 rated at 300 psi which pumps hydraulic fluid from reservoir 40 through hydraulic line 69, through pump 21, manifold 48 and to hydraulic cylinders 15, 16, 52, and 53 which act as means to lift rollers 11 and 12. Pressurized oil (hydraulic fluid) flows through manifold 48 and hydraulic fluid lines 41–44 and the oil returning from manifold 48 moves through bypass line 49 to reservoir 40. When pump 21 is activated by either foot actuator 50, 51 and cylinders 15, 16, 52 and 53 are not activated by control actuator buttons 31–34, oil also returns to reservoir 40 through line 49. In FIG. 3, hydraulic lines 41 and 42 are joined respectively to solenoid valves 61 and 60 as each hydraulic cylinder is connected to an independent solenoid valve as shown in FIGS. 2 and 3 although one solenoid could be used for each roller. As earlier mentioned, hydraulic oil is pumped from reservoir 40 into pump 21 through oil line 69 and oil can be drained from reservoir 40 by removing drain plug 70 and oil is replenished by removing fill plug 71 and filling as needed. Plug 71 is conventionally vented to prevent excess pressure build-up. Solenoid valves 60, 61, 62 and 63 are standard 7.5 volt DC two way solenoid valves which force the cylinder pistons upwardly or downwardly depending on the direction required. The solenoid valves "lock" the cylinder piston in position and will not allow it to move unless actuated for safety purposes. In another embodiment of the hydraulic system, only a pair of solenoid valves could be utilized as seen in FIG. 5.

Figure 4:
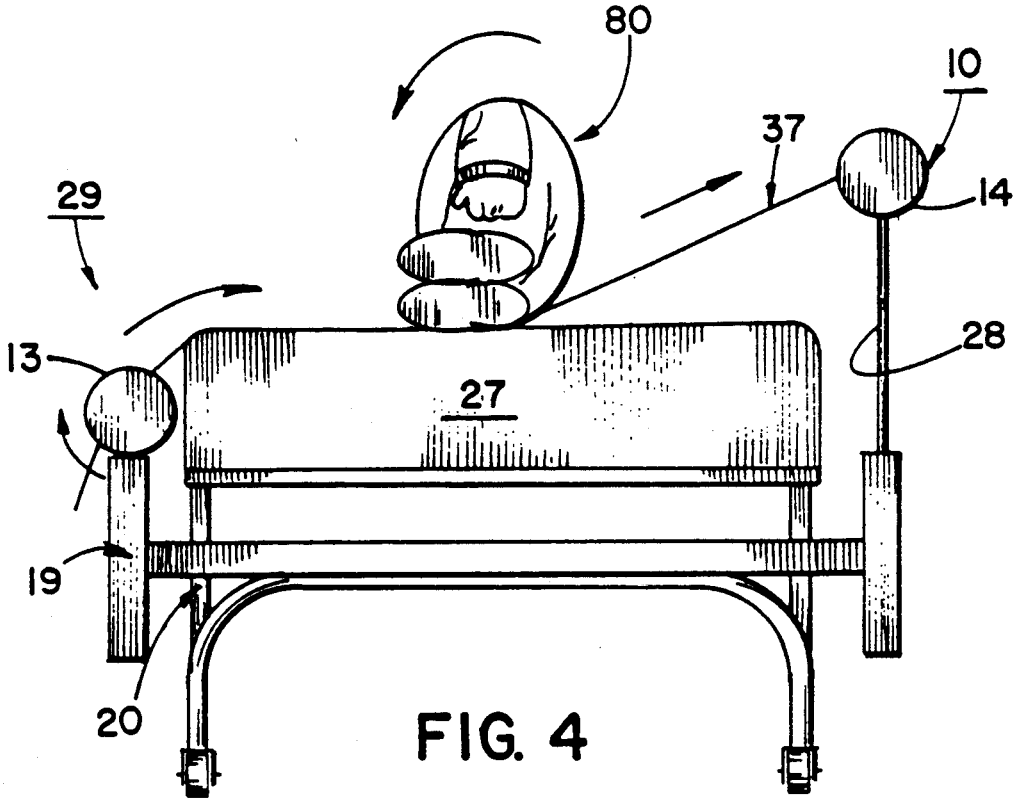
FIG. 4 pictures an end elevation view of the device with a patient being rolled thereon.
Figure 6:
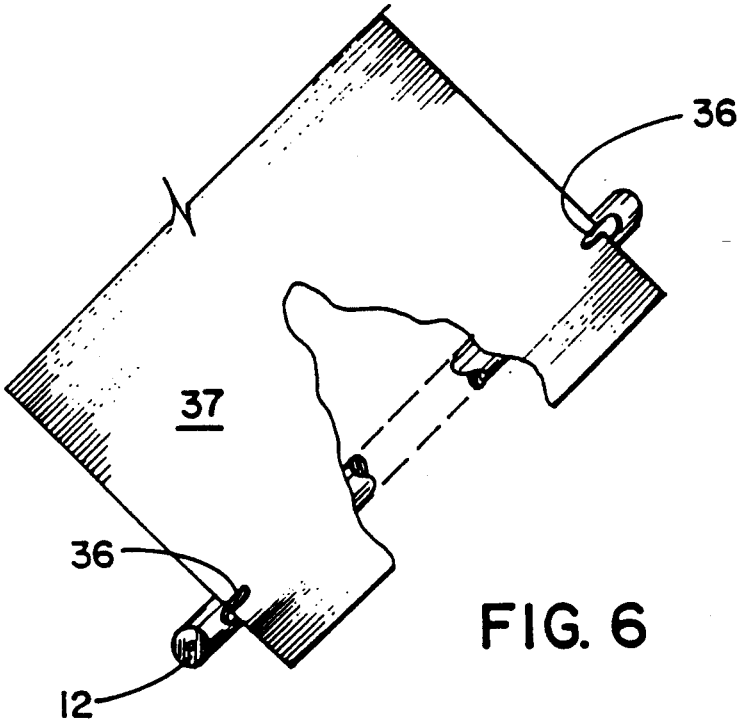
FIG. 6 illustrates in fractured form the belt joined to one of the rollers.

As illustrated in FIG. 1, rollers 11 and 12 are positioned respectively on the left and right sides of bed frame 20 in longitudinal alignment with bed 29 having mattress 27 thereon. Belt 35 may be a conventional bed sheet 37 folded in half which has been joined by fasteners 36 to rollers 11 and 12 as shown in FIGS. 4 and 6. As is further shown in FIG. 4, as belt 35 is turning in a clockwise direction, fasteners 36 hold sheet 37 by frictional engagement to roller 12 as seen in FIG. 6 and sheet 37 is easily removed and replaced with a clean sheet as required for a particular patient. Sheet 37 which may be joined to one roller or the other with a free end 38 as seen in FIG. 1 for patient rotation. In FIG. 4 roller 12 (not shown) is raised with the extension of rear piston rod 28 of cylinder 53 and front piston rod 38 (not shown) of cylinder 52. As would be further understood, with belt 35 turning in a clockwise direction and with roller 12 in a raised posture, the patient which may be a large adult male would naturally roll to the left as shown in FIG. 4 from a supine to a prone position. For a particular patient, left roller 11 could likewise be raised while roller 12 is in a downward position and with belt 35 turning in a counterclockwise direction, the patient could be moved in an opposite rotation. In a certain case, with injuries being on a specific side of the patient, the left or right roller may be most useful in lifting and turning the patient in the most efficient manner.

Figure 5:
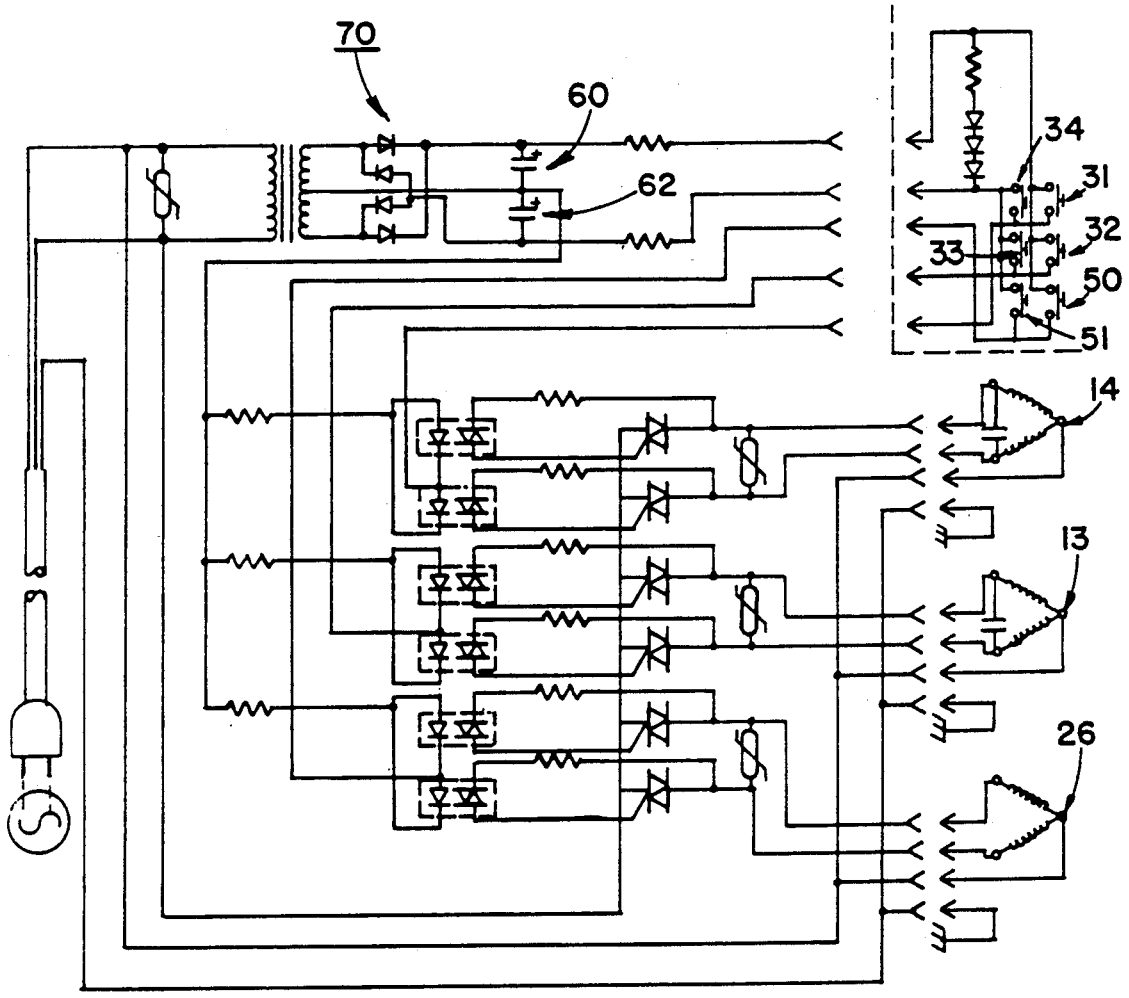
FIG. 5 depicts a partial schematic view of one embodiment of the electrical circuitry of the invention.

Electrical schematic 70 while seen in FIG. 5 only illustrates certain of the electrical circuitry including a 120 volt AC line voltage with a control voltage of 7.5 volts for two way DC solenoid valves 60 and 62. Motors, switches and other components are preferrably "explosion proof" since apparatus 10 oftentimes is used near oxygen or other combustible gases. In this schematic only two solenoid valves are used, one for the left and one for the right roller cylinders. As further seen in FIG. 5, by depressing either left foot actuator 50 or right foot actuator 51, pump motor 26 drives pump 21 as shown in FIG. 2. By depressing button 31 of hand control actuator 23, with foot actuator 51 depressed, roller 12 lifts and rotates in clockwise direction as shown in FIG. 4. Next, with the patient rotated, button 34 of hand control actuator 23 is depressed which will lower roller 12 to its normal position as shown in FIG. 1. Likewise, by depressing foot actuator 50, and by depressing button 32 of hand control actuator 23, left roller 11 will lift as shown in FIG. 3 and will rotate in a counterclockwise direction. Likewise, to lower roller 11, button 33 is depressed while foot actuator 50 is activated. If foot pedal 50 remains activated, pump motor 26 will continue to run and pump 21 will continue to apply hydraulic pressure to said solenoid valve as shown in FIG. 3 but bypass line 49 will return hydraulic fluid to reservoir 40.

While electric and hydraulic power are used to control and drive the rollers and lift means respectively, as shown herein other types of apparatus can be used such as mechanical, pneumatic, electrical or a combination of types as desired.

Other configurations of device 10 may be manufactured to lift a patient by hydraulic or other means without utilizing a belt joined to a roller as lifting means alone may be of value in certain circumstances in moving or turning particular patients.

The illustrations and examples provided herein are for explanatory purposes and are not intended to limit the scope of the appended claims.

I claim:

1. A hospital bed device for assisting the movement and rotation of a bedridden patient to prevent prolonged motionless periods thereof, the device for attachment to a conventional hospital bed comprising: a frame, a pair of sets of hydraulic cylinders, said frame positioned proximate said hospital bed and connected to said pair of hydraulic cylinder sets, one of said pair of hydraulic cylinder sets positioned on each side of said bed, a pump, an electric motor, said motor joined to said pump, a manifold, a fluid reservoir, said manifold in fluid communication with said pump and said reservoir, a foot actuator, said actuator joined to said pump for activating said pump, said manifold in communication with said hydraulic cylinder sets, a hydraulic cylinder selectively locking solenoid valve, said solenoid valve joined to one of said hydraulic cylinders, said locking solenoid valve for selectively locking said cylinder in a variety of extended positions, a pair of rollers, each of said pair of rollers rotatably joined to one of said hydraulic cylinder sets, means to turn said rollers, said roller turn means joined to said rollers, a hand held actuator for raising and rotating said rollers, said hand held actuator connected to said roller turn means and to said locking solenoid valve, said hand held actuator responsive to said foot actuator, a belt, said belt positioned across said bed and attached to said rollers whereby a patient positioned on said belt, upon activation of said hand held actuator, will be moved as said belt is rotated, and upon simultaneous activation of both said hand and said foot actuators said patient can be raised.

2. A hospital bed device as claimed in claim 1 wherein said foot actuator is joined to said pair of hydraulic cylinder sets.

3. A hospital bed as claimed in claim 1 and including a fluid return line, said return line joined to said reservoir.

* * * * *